US011326393B2

(12) United States Patent
Gosling et al.

(10) Patent No.: US 11,326,393 B2
(45) Date of Patent: May 10, 2022

(54) DOOR WITH ACOUSTIC SEALS

(71) Applicant: DIRTT ENVIRONMENTAL SOLUTIONS INC., Salt Lake City, UT (US)

(72) Inventors: Geoff W. Gosling, Calgary (CA); Thomas A. Brown, Calgary (CA); Joseph Anthony Vulic, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 93 days.

(21) Appl. No.: 16/641,060

(22) PCT Filed: Jan. 23, 2019

(86) PCT No.: PCT/US2019/014831
§ 371 (c)(1),
(2) Date: Feb. 21, 2020

(87) PCT Pub. No.: WO2019/147726
PCT Pub. Date: Aug. 1, 2019

(65) Prior Publication Data

US 2021/0047880 A1 Feb. 18, 2021

Related U.S. Application Data

(60) Provisional application No. 62/620,956, filed on Jan. 23, 2018.

(51) Int. Cl.
*E06B 7/21* (2006.01)
*E06B 3/46* (2006.01)
(Continued)

(52) U.S. Cl.
CPC ..... *E06B 7/21* (2013.01); *E06B 3/4636* (2013.01); *E06B 7/215* (2013.01); *E06B 7/2316* (2013.01)

(58) Field of Classification Search
CPC ..... E06B 7/21; E06B 7/215; E06B 3/4636; E06B 3/4645; E06B 3/4649; E06B 3/42; E06B 3/46; E05Y 2201/694
See application file for complete search history.

(56) References Cited

U.S. PATENT DOCUMENTS 3,871,133 A * 3/1975 Ellingson, Jr. ..... E06B 7/2316 49/308
6,125,584 A * 10/2000 Sanders ..... E06B 7/215 49/310
(Continued)

FOREIGN PATENT DOCUMENTS

EP 1431501 A2 * 6/2004 ..... E06B 7/2309
EP 1431501 A2 6/2004
(Continued)

OTHER PUBLICATIONS

International Search Report for PCT/US2019/014831 dated Jul. 22, 2019.

*Primary Examiner* — Marcus Menezes
(74) *Attorney, Agent, or Firm* — Workman Nydegger

(57) ABSTRACT

A sliding door system (105) includes a track assembly (120) and a door (125) slidably connected to the track. Seals (245, 250, 605, 610, 300, 500) disposed about the door limit sound and/or infectious materials from passing thereby. One or more of the seals (245, 250) are disposed between the door and the track assembly. One or more other seals (605, 610) are disposed between the door and a wall to seal around the trailing end of the door. The system may also include a door dock (130) with one or more seals (300, 500) to seal around the leading end of the door. The system can also include a drop seal assembly (700) that selectively seals off a gap between the bottom of the door and the floor.

20 Claims, 9 Drawing Sheets

(51) Int. Cl.
*E06B 7/215* (2006.01)
*E06B 7/23* (2006.01)

(56) References Cited

U.S. PATENT DOCUMENTS

| | | | | |
|---|---|---|---|---|
| 2004/0003556 | A1* | 1/2004 | Zerbst | E05D 15/0643 52/220.7 |
| 2004/0107642 | A1 | 6/2004 | Liebscher | |
| 2007/0200370 | A1* | 8/2007 | Reithmeyer | E05B 65/087 292/340 |
| 2009/0145062 | A1 | 6/2009 | Kalempa | |
| 2011/0126471 | A1* | 6/2011 | Hans | E06B 3/5072 49/409 |
| 2012/0255232 | A1* | 10/2012 | Gayhart | E05F 15/72 49/360 |
| 2013/0219792 | A1* | 8/2013 | Parker | E06B 7/215 49/306 |
| 2017/0362881 | A1* | 12/2017 | Gosling | E05F 1/16 |
| 2018/0148966 | A1* | 5/2018 | Sakabe | E06B 3/4645 |
| 2021/0102420 | A1* | 4/2021 | Goldfinch | E06B 7/2303 |

FOREIGN PATENT DOCUMENTS

| | | | | |
|---|---|---|---|---|
| EP | 1450002 | A1 | 8/2004 | |
| EP | 1860272 | A2 | 11/2007 | |
| EP | 2366857 | A2 | 9/2011 | |
| EP | 3284896 | A1 * | 2/2018 | E06B 7/215 |
| WO | WO-03074829 | A1 * | 9/2003 | E06B 3/4618 |
| WO | 2009155295 | A1 | 12/2009 | |
| WO | WO-2018187009 | A1 * | 10/2018 | E05D 15/0652 |

* cited by examiner

DOOR WITH ACOUSTIC SEALS

CROSS-REFERENCE TO RELATED APPLICATIONS

The present invention is a 35 U.S.C. § 371 U.S. National Stage of PCT Application No. PCT/US2019/014831, filed on Jan. 23, 2019, which claims priority to U.S. Provisional Patent Application No. 62/620,956, filed Jan. 23, 2018. The entire content of each of the aforementioned patent applications is incorporated herein by reference.

BACKGROUND

1. Technical Field

The present disclosure relates generally to door systems and components, such as door systems and components for use with modular walls and that include seals that provide acoustic and/or infection control.

2. Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices or conference rooms depending on the organization's needs and size constraints. Some organizations will prefer to build permanent walls and structures to partition the space, which can be prohibitively expensive and time consuming. Accordingly, other organizations will partition the space with modular assemblies. Modular assemblies can be relatively easy to assemble. Additionally, if the needs of the organization change, the modular assemblies can be disassembled and reassembled in a different configuration.

For example, modular office partitions typically include a series of individual wall modules (or panels) that can be expeditiously placed into a particular partition position to create at least an outline of a cubicle, office, or conference room. That is, a manufacturer or assembler can typically take a given set of wall modules, and align the wall modules along a floor pattern until the desired configuration is achieved. The manufacturer or assembler can then secure the given wall modules in position. The assembled partitions can be either free-standing, or can be rigidly attached to the surrounding permanent support structures. A "finished" look is generally completed by adding trim pieces in the joints between panels or wall modules and/or surrounding structures.

In addition, one will appreciate that many modular wall partitions will need to implement a closure apparatus, such as a door. Doors are manufactured for use in a variety of settings including both exterior as well as interior settings. Manufacturers fabricate doors to suit the end uses found in the various applications in which the doors are to be used. In turn, doors provide a convenient way to enter and exit structures or interior spaces as well as to selectively open and close entrances. The necessary configuration of a particular door is determined by the specific requirements of the site where the door is being installed. These requirements may dictate the direction a door is to be opened, the type of door to be used, the configuration of mounting hardware, and how the door is to be installed, among other aspects.

Of course, there are many types of doors from which to choose. In some cases, a manufacturer or designer will opt for a conventional swinging door, while in other cases, the manufacturer might opt for a sliding door configuration, whether for various aesthetic or space saving purposes. Regardless of the specific style or layout of the door, a manufacturer will typically need to fabricate a given door to suit a specific end-use found in the various applications in which the doors are to be used.

One consideration that should be taken into account is whether the door needs to provide functionality in addition to just opening or closing off a space. For instance, in some cases, doors need to provide an acoustical barrier between adjacent spaces. Similarly, particularly in healthcare settings, some doors need to provide an infection control barrier. While providing acoustic and/or infection control barriers for swinging doors can be relatively simple, providing such barriers for sliding doors poses more complex challenges.

For example, generally there are gaps left between a sliding door and the wall to which the door is connected. Gaps above, below, and beside the door can enable the smooth sliding of the door. If manufacturers or users add mechanisms to close the gaps, those mechanisms can impede the movement of the sliding door. Further, the added mechanisms can detract from the overall appearance of the door by adding visible and unattractive hardware.

Accordingly, there remains room for improvement in the area of dividing interior spaces. In particular, there remains room for improvement in terms of sliding door systems that provide acoustic and/or infection control barriers between adjacent spaces.

BRIEF SUMMARY

Implementations of the present disclosure comprise systems, methods, and apparatus for modular wall construction and design. More specifically, implementations of the present disclosure relate to door systems and components, such as door systems and components for use with modular walls and that include seals that provide acoustic and/or infection control.

In at least one implementation the door system comprises a sliding door track assembly that includes a track having a roller channel. The door system can also include a door that is movably connectable to the track, wherein the door has an open configuration and a closed configuration. Further, the door system can comprise one or more track assembly seals disposed between the track assembly and the door. Finally, the door system can include a drop seal assembly connected to a lower end of the door, wherein the drop seal assembly is configured to seal the gap between the door and a floor when the door is moved from the open configuration to the closed configuration.

Next, in at least one implementation the door system comprises a track assembly that includes a track having a roller channel. The door system can also include a door slidably connected to the track assembly to enable the door to move between an open configuration and a closed configuration, the door having a leading end and a trailing end. Also, the door system can include a drop seal assembly configured to actuate from a non-sealed configuration to a sealed configuration when the door is moved from the open configuration to the closed configuration, thereby sealing a gap between the door and a floor. Lastly, the door system can include a door dock configured to receive or engage the leading end of the door, the door dock comprising one or more docking seals that engage the leading end of the door when the door is closed.

In at least one implementation, the door system comprises a sliding door, wherein the door has an open configuration and a closed configuration. The door system can also include a drop seal assembly. The drop seal assembly can be configured to actuate from a non-sealed configuration to a sealed configuration when the door moves from the open configuration to the closed configuration, thereby sealing a gap between the door and a permanent structure. Also, the drop seal assembly can be configured to actuate from the sealed configuration to the non-sealed configuration when the door moves from the closed configuration to the open configuration, thereby unsealing the gap between the door and the permanent structure.

The drop seal assembly can include an activation member that extends from a leading end of the door when the door is in an open configuration and that is configured to move inward into the door when the door is moved into the closed configuration. The activation member can be linked to a drop seal such that inward movement of the activation member causes the drop seal to be lowered.

Further, the drop seal assembly can include a biasing member linked to the drop seal such that the biasing member raises or retracts the drop seal when the door is moved from the closed configuration to the open configuration.

Finally, the activation member, the biasing member, and the drop seal can be linked together by a scissor mechanism. The scissor mechanism can include a first scissor member connected between the activation member and the drop seal and a second scissor member connected between the biasing member and a frame of the drop seal assembly. The first and second scissor members can be pivotally connected to one another and pivot about a common pivot axis. The first and second scissor members can be configured to pivot between more vertical and more horizontal orientations. The drop seal is lowered when the first and second scissor members are pivoted to the more vertical orientation and raised or retracted when the first and second scissor members are pivoted to the more horizontal orientation.

BRIEF DESCRIPTION OF THE DRAWINGS

In order to describe the manner in which the above-recited and other advantages and features of the invention can be obtained, a more particular description of the invention briefly described above will be rendered by reference to specific implementations and/or implementations thereof which are illustrated in the appended drawings. Understanding that these drawings depict only typical implementations and/or implementations of the invention and are not therefore to be considered to be limiting of its scope, the invention will be described and explained with additional specificity and detail through the use of the accompanying drawings in which.

DETAILED DESCRIPTION

Implementations of the present disclosure comprise systems, methods, and apparatus for modular wall construction and design. More specifically, implementations of the present disclosure relate to door systems and components, such as door systems and components for use with modular walls and that include seals that provide acoustic and/or infection control.

At least one implementation of the present invention offers several advantages over other door systems. For example, implementations of the present invention can be used in a wide range of environments where both aesthetics and functional aspects related to sealing out sound and infection may be desired. Along these lines, many of the seals described herein can be hidden from the view of the user and therefore do not detract from the overall appearance of the door system.

Also, in at least one implementation, the seals are configured not to impede the sliding movement of the door, while still providing acoustic/and or infection control. For instance, the door system can include track assembly seals that engage opposing sides of a door to limit sounds or infectious materials from passing between the door and a track assembly. The track assembly seals can also limit or prevent infectious materials from accumulating in the space between the door and the track assembly. Because the track assembly seals can be formed of a material (e.g., rubber, PVC, etc.) that is able to flex against the surface of the door, as the door opens and closes, the door can slide between the track assembly seals.

Further, docking seals and vertical frame seals can be placed and configured to seal the gap between the door and a door dock or a vertical frame member, respectively, only when the door is in a closed configuration. Therefore, in at least one implementation docking seals and vertical frame seals do not interfere with the sliding movement of the door, but can take a greater role when needed. Along these lines, a drop seal assembly disclosed herein can be configured to seal a gap between a sliding door and a floor only when the door is in the closed configuration. Thus, in at least one implementation, the drop seal assembly will not impede the movement of the door when the door is in an open configuration, but can maintain a relatively snug seal between the door and floor when closed.

Figure 1:
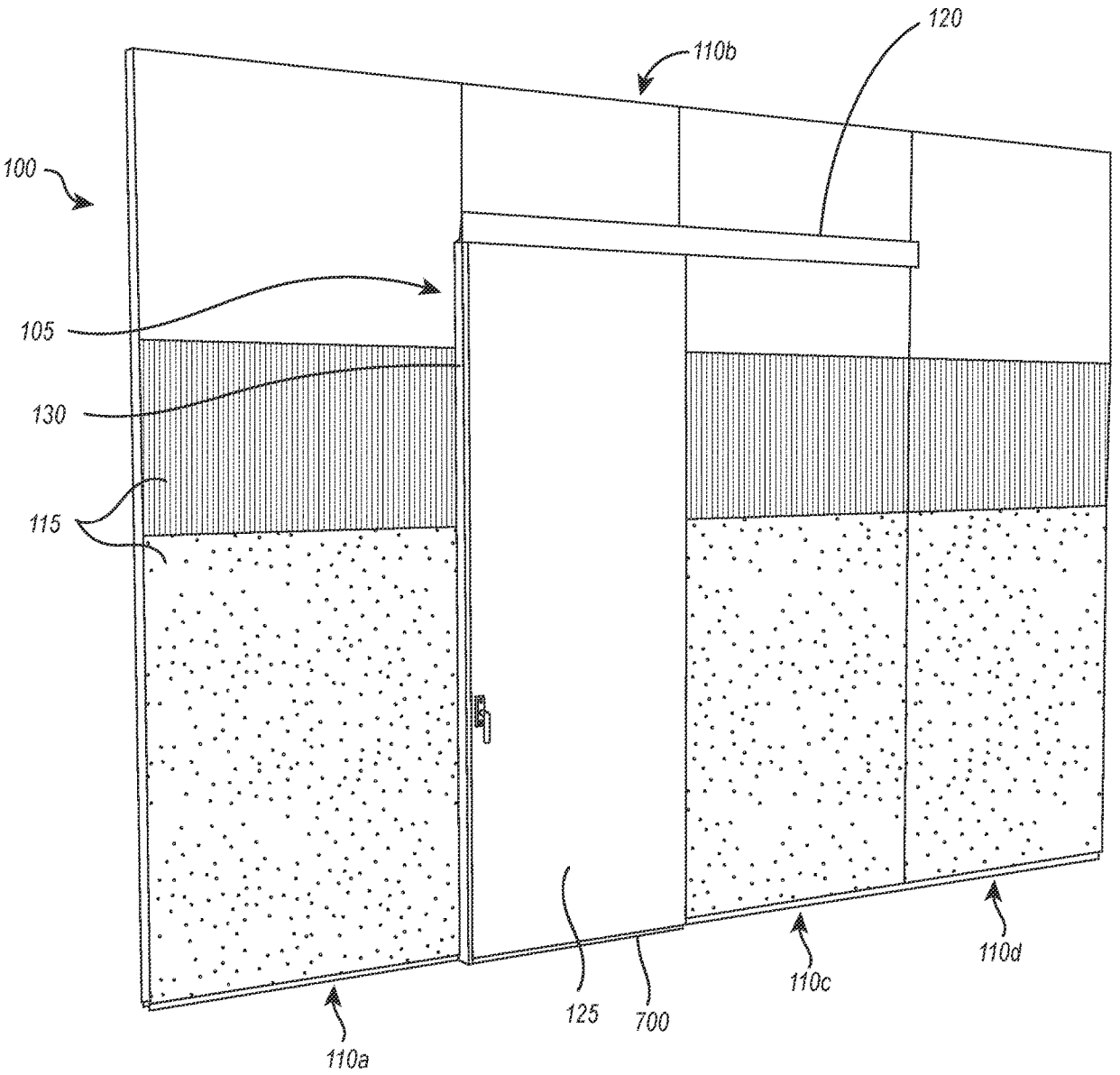
FIG. 1 illustrates a perspective view of a modular wall system in accordance with an implementation of the present disclosure.

Turning now to the Figures, FIG. 1 illustrates perspective view of a modular wall system 100 with a sliding door 105 in accordance with implementations of the present disclosure. The modular wall system 100 includes multiple wall modules 110 (e.g., 110*a*, 110*b*, 110*c*, 110*d*). Each of the wall modules 110 includes an internal frame (including horizontal and vertical frame members that are not shown) and one or more tiles 115 connected thereto.

FIG. 1 shows that the sliding door system 105 can be connected to a modular wall system, such as modular wall system 100. FIG. 1 further shows that the sliding door system 105 can include a track assembly 120, a door 125, and a door dock 130. The door 125 can slide along the track assembly 120 to open or close a doorway in modular wall system 100. The doorway in the illustrated implementation is disposed between wall modules 110*a*, 110*c* and below wall module 110*b*. As discussed in greater detail below, the sliding door system 105 and optionally the modular wall system 100 can include one or more sealing mechanisms that provide acoustic dampening and/or infection control when the door 125 is closed as shown in FIG. 1. For example, FIG. 1 shows a drop seal assembly 700, as discussed more fully with respect to FIGS. 7A-7C herein.

Figure 2:
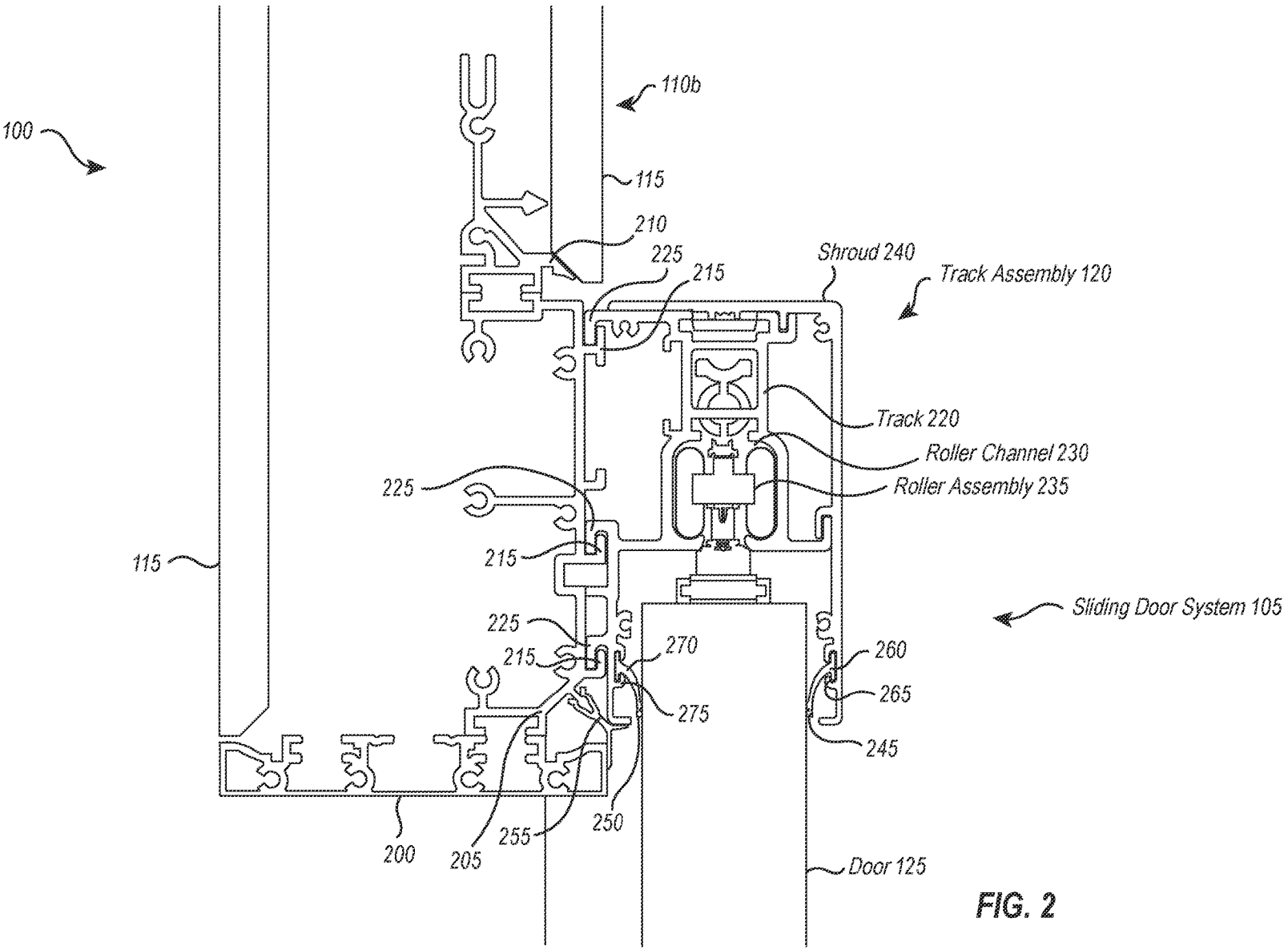
FIG. 2 illustrates a partial cross-section view of a track assembly in accordance with implementations of the present disclosure.

FIG. 2 illustrates a partial cross-sectional view of wall module 110*b* and sliding door system 105. As can be seen, wall module 110*b* includes a doorway header 200 and horizontal frame members 205 and 210. Doorway header 200 can optionally form a portion of the structural frame for wall module 110*b* as well as provide a finished look for the doorway through modular wall 100. Similarly, horizontal frame members 205 and 210 can form portions of the structural frame for wall module 110*b*. Wall surface tiles 115 can be connected to horizontal frame member 210.

As shown in FIG. 2, the horizontal frame members (e.g., 205) may include one or more connection features 215 to which track assembly 120 may be connected. For instance, in the illustrated implementation the connection features include upwardly facing channels 215 (e.g., at upper, middle, and lower positions of frame member 205) that are configured to receive corresponding connection features from track assembly 120. More specifically, track assembly 120 includes a track 220 with connection features in the form of downwardly facing hooks 225 (e.g., disposed at upper, middle, and lower positions of track assembly 220). The downwardly facing hooks 225 can be positioned within the upwardly facing channels of connection features 215 so that track 220 hangs or is cantilevered from horizontal frame member 205.

In at least one implementation, a manufacturer or assembler can use a fastener (not shown) to secure track 220 to horizontal frame member 205 to prevent track 220 from becoming unintentionally disengaged from horizontal frame member 205. For instance, a fastener may be passed through track 220 below the middle downward facing hook 225 such that the end of the fastener is positioned below the middle, upwardly facing channel 215 on horizontal frame member 205. The fastener can therefore prevent track 220 from moving vertically in a way that would disengage the connection features 220 and 225 from one another.

The track 220 can also include a roller channel 230 that can receive one or more roller assemblies 235 therein, and through which the roller assemblies 235 may selectively move. The roller assemblies 235 can be connected to the upper end of the door 125. Movement of the door 125 relative to the track 220 causes the roller assemblies 235 to move within the roller channel 230.

FIG. 2 further shows that the track assembly 120 can also include a shroud 240. The shroud 240 can enclose or cover a substantial portion of the track 220 and the space between the track 220 and the door 125, thereby providing a finished look. The shroud 240 can be connected to the track 220 with one or more fasteners, connection features, or the like. For instance, a fastener may extend through a top surface of the shroud 240 and into a spline (not shown) disposed within a channel in the track 220. Alternatively, the fastener can extend through the top surface of the shroud 240 and into the track 220 itself.

The modular wall 100 and the sliding door system 105 can also include one or more seals near the upper end of the door 125. The seals may provide acoustic dampening and/or infection control properties to limit the amount of sound or infectious material that are able to pass thereby. For instance, FIG. 2 shows that a first track assembly seal 245 is connected to an interior of shroud 240 at a lower end thereof. The first track assembly seal 245 includes a connection feature 260 that engages a corresponding or mating connection feature 265 on shroud 240. The first track assembly seal 245 extends from shroud 240 towards and engages the door 125 to seal the gap between door 125 and shroud 240.

Similarly, a second track assembly seal 250 is connected to track 220 on a side opposite seal 245. The second track assembly seal 250 includes a connection feature 270 that engages a corresponding or mating connection feature 275 on track 220. FIG. 2 shows that the second track assembly seal 250 extends from track 220 towards and engages the door 125 to seal the gap between door 125 and track 220. Accordingly, track assembly seals 245 and 250 engage opposing sides of the door 125 to limit sounds or infectious materials from passing between door 125 and track assembly 120. The track assembly seals 245 and 250 can also limit or prevent infectious materials from accumulating in the space between the door 125 and the track assembly 120.

The track assembly seals 245 and 250 can be formed of a material (e.g., rubber, PVC, etc.) that is able to flex against the surface of the door 125. As the door 125 opens and closes, the door 125 can slide between the track assembly seals 245 and 250. Thus, the track assembly seals 245 and 250 can remain relatively stationary while the door 125 moves relative thereto.

FIG. 2 further shows that doorway header 200 can also include a horizontal frame seal 255 for sealing the space between doorway header 200 and track 220. In the illustrated implementation, the seal 255 is connected to horizontal frame member 205 via mating connection features. The seal 255 extends from horizontal frame member 205 and towards or through a gap between doorway header 200, and track 220. In the illustrated implementation, the seal 255 includes two tails that extend away from one another and engage the doorway header 200 and the track 220 to seal the gap therebetween.

The horizontal frame seal 255 can limit sounds and/or infectious material from passing through wall module 110*b* through the gap formed between doorway header 200 and track 220. The horizontal frame seal 255 can also limit or prevent infectious materials from entering or accumulating in the space within wall module 110*b*. Similar seals may be included to seal off gaps between other components of wall module 110*b* or the other wall modules.

Figure 3:
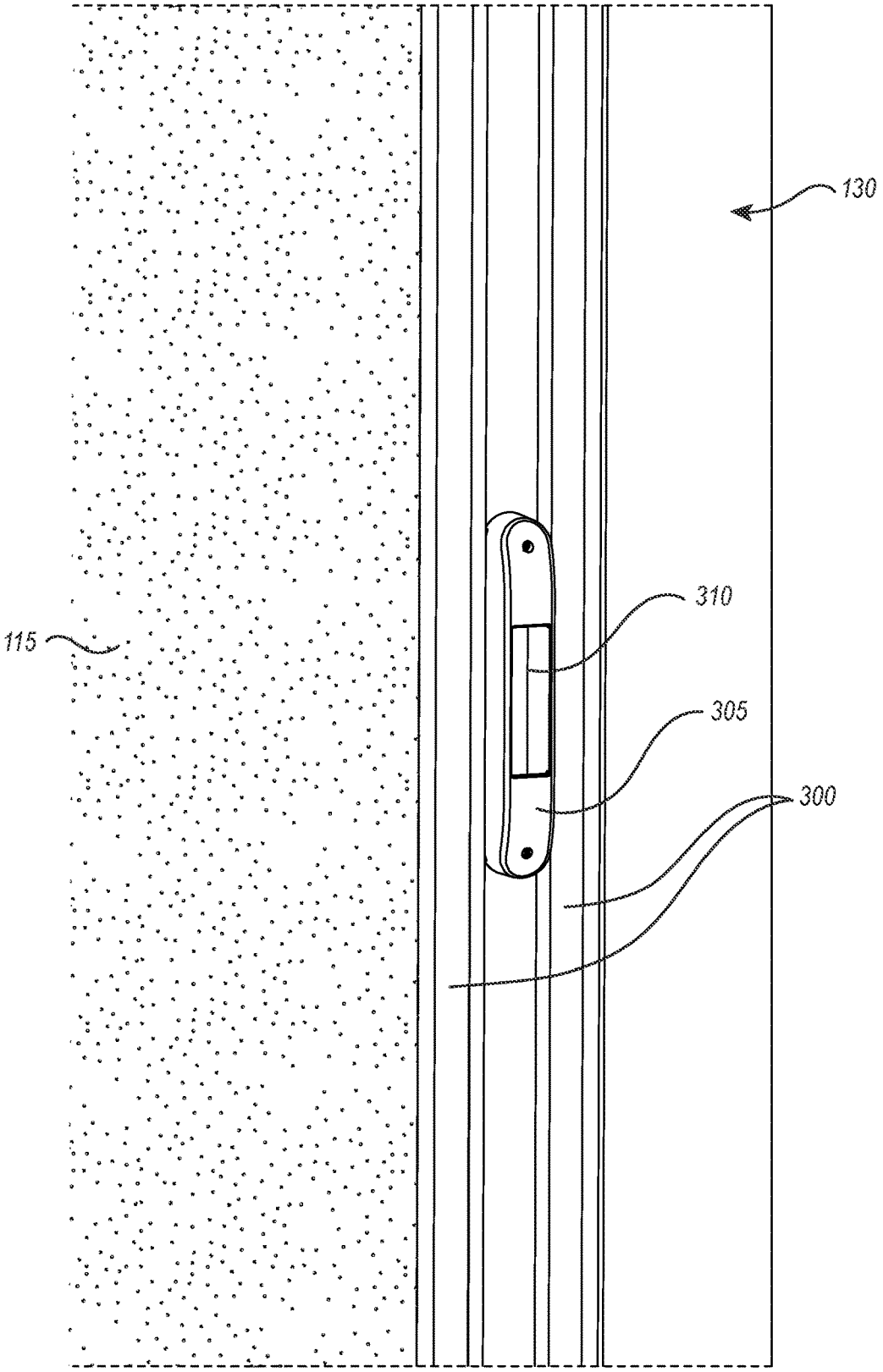
FIG. 3 illustrates a perspective view of a portion of a door dock of a modular wall system in accordance with an implementation of the present disclosure.
Figure 4:
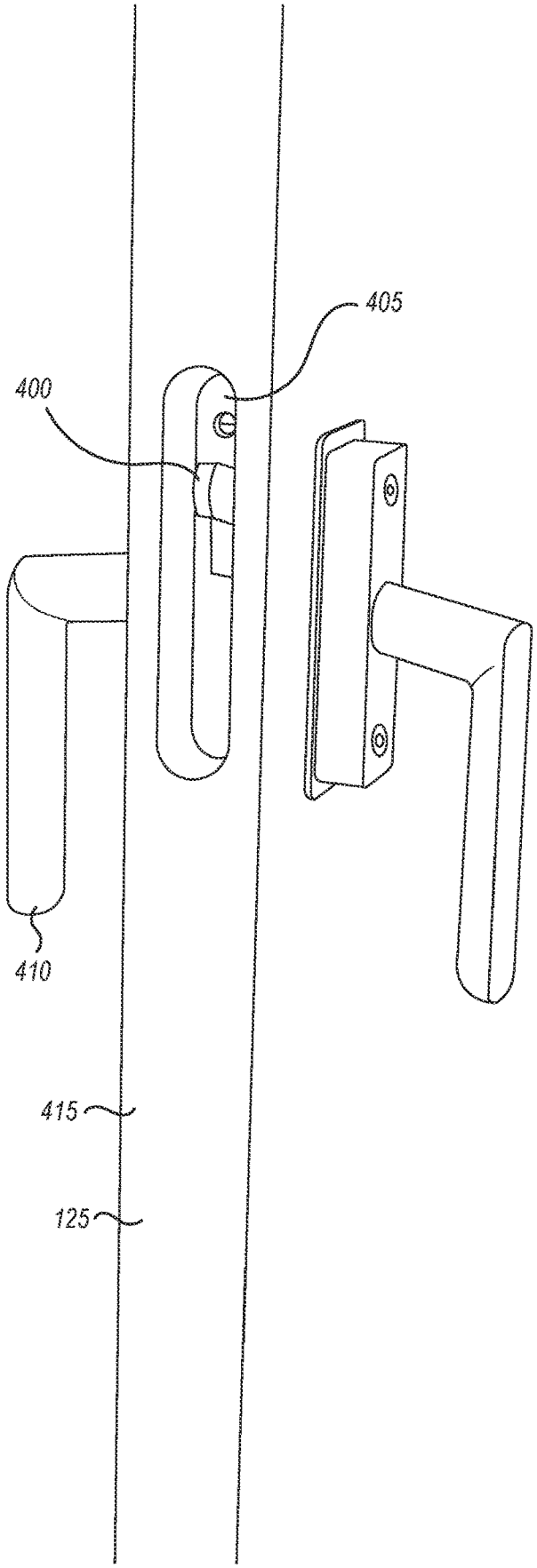
FIG. 4 illustrates a perspective view of a latch of a door of a modular wall system in accordance with an implementation of the present disclosure.

FIGS. 3-5 illustrate various aspects of the door dock 130 and latching features of the door 125. For instance, FIG. 3 shows an interior view of a portion of the door dock 130.

The door dock 130 comprises an edge of a wall module (e.g., 110*a*, which can include a tile 115), and is configured correspondingly to receive a leading end 415 (see FIG. 4) of a door (e.g., 125) when the door is closed. When the door is closed, a gap may exist between the door dock 130 and the door. To limit sounds or infectious material from passing through the gap, the door dock 130 may include one or more docking seals 300 that seal the gap between the door and the door dock 130. The docking seals 300 can be formed of a material (e.g., rubber, PVC, etc.) that is able to flex against the surface of the door 125.

FIG. 3 also shows that in at least one implementation the door dock 130 includes a latch receptacle 305, which extends laterally therefrom. As further understood with respect to FIG. 4, latch receptacle 305 can be configured to fit within a corresponding recess 405, and thereby enable the leading edge 415 of door 125 to fit snugly against door dock 130 (e.g., via seals 300, FIG. 5A). In addition, FIG. 3 shows that latch receptacle 305 can include a cutout portion 310 that is configured to receive and selectively connect to a latch (e.g., 400, FIG. 4) from the door 125.

FIG. 4 illustrates a perspective view of a latch 400 of a door 125 of a modular wall system in accordance with an implementation of the present disclosure. As shown, the door 125 can include a latch 400 disposed within a recess 405. The recess 405 in the side of the door 125 may be large enough to receive at least a portion of the latch receptacle 305 shown in FIG. 3. By receiving the latch receptacle 305 within the recess 405 in the door 125, the latch 400 can engage the latch receptacle 305 to secure the door 125 in a closed configuration.

The recessed nature of the lock set prevents the latch 400 from protruding out of the leading edge 415 of the door 125. Keeping the latch 400 recessed within the door 125 can prevent people or objects from getting caught on the latch 400.

As can be seen in FIG. 4, the door 125 also includes a handle 410 that can be used to activate the latch 400. More specifically, rotation of the handle 410 can cause the latch 400 to move between an engaged position and a disengaged position. When the latch 400 is in the disengaged position, the door 125 is free to open. In contrast, when the latch 400 is in the engaged position and connected within latch receptacle 305, the door 125 is held in a closed configuration.

In at least one implementation, the handle 410 is positioned relative to the door dock 130 to meet certain codes or accommodate specific needs. For instance, the handle 410 can be positioned far enough away from the door dock 130 if needed so that a person can fit a closed fist therebetween in order to rotate the handle 410.

Of course, one of skill in the art will appreciate that the present invention is not limited to the door dock 130 and latch configurations shown in FIGS. 3 and 4. In at least one implementation, the door dock 130 alternatively includes a latch receptacle 305 that is recessed into the door dock 130. The door dock 130 can also not include a cutout portion 310. Also, in at least one implementation, the door dock 130 does not include a latch receptacle 305.

Figure 5A:
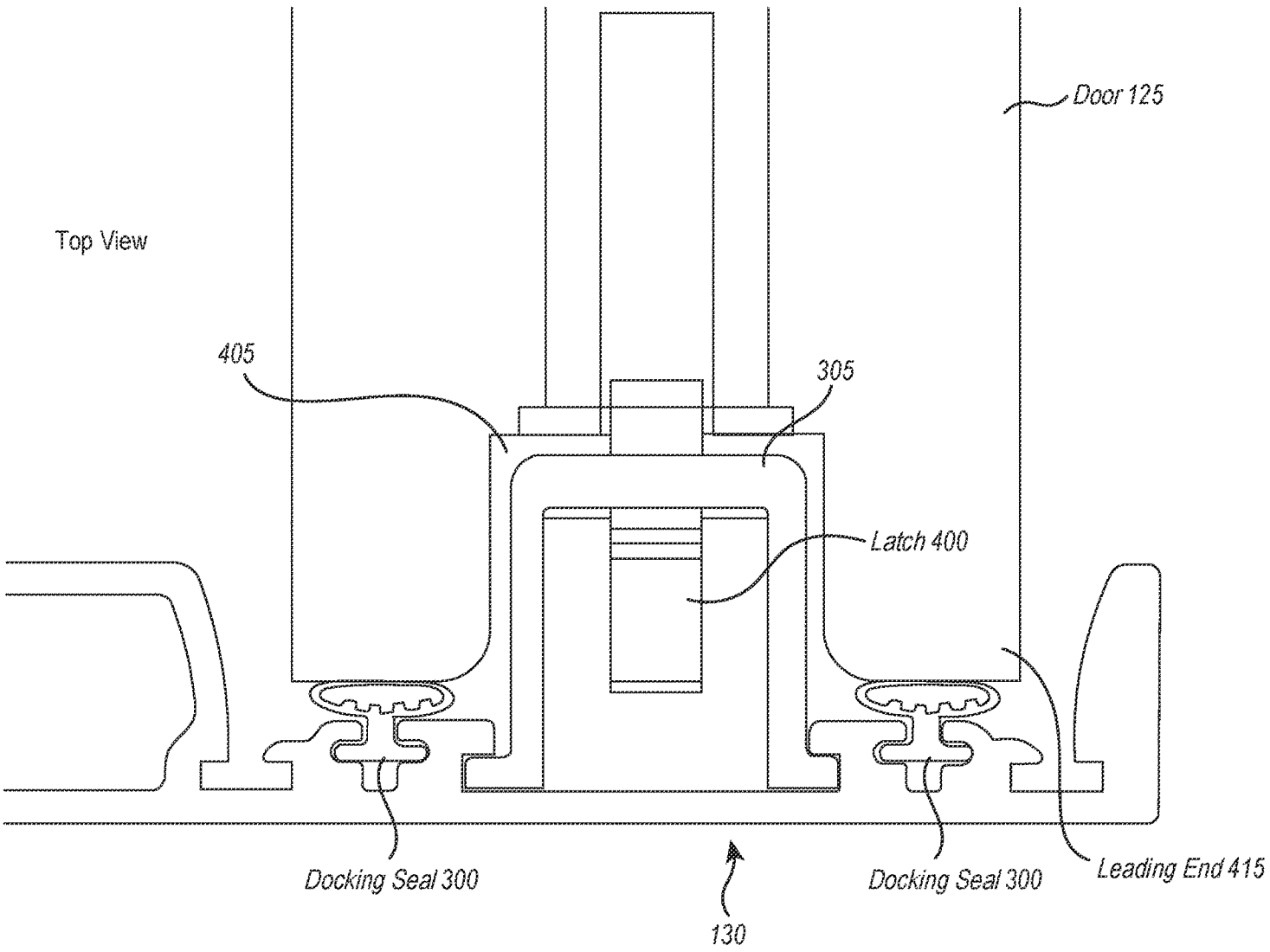
FIG. 5A illustrates a partial cross-sectional view of a connection point between a door and a door dock of a modular wall system in accordance with an implementation of the present disclosure.

FIG. 5A illustrates a partial cross-sectional view of a connection point between the door 125 and closed in the door dock 130. As can be seen, the leading edge 415 of the door 125 engages the docking seals 300, thereby sealing the gap between the door 125 and the door dock 130. As shown in FIG. 5A, the door dock 130 includes two docking seals 300 that include a connection feature that mates with a corresponding connection feature of the door dock 130. The two docking seals 300 can be spaced apart such that a latch receptacle 305 can be disposed therebetween, as shown in FIG. 3, and provide a snug fit between the leading edge 415 of door 125 and the corresponding wall module (e.g., 110*a*), or frame element thereof.

Further, FIG. 5A also illustrates how the recess 405 in the side or leading edge 415 of the door 125 can be large enough to receive at least a portion of the latch receptacle 305 shown in FIG. 3. By receiving the latch receptacle 305 within the recess 405 in the door 125, the cutout portion 310 of the latch receptacle can receive and selectively connect thereto the latch 400 to secure the door 125 in a closed configuration, and thereby further enable a snug fit of the leading edge 415 of the door and wall module.

Figure 5B:
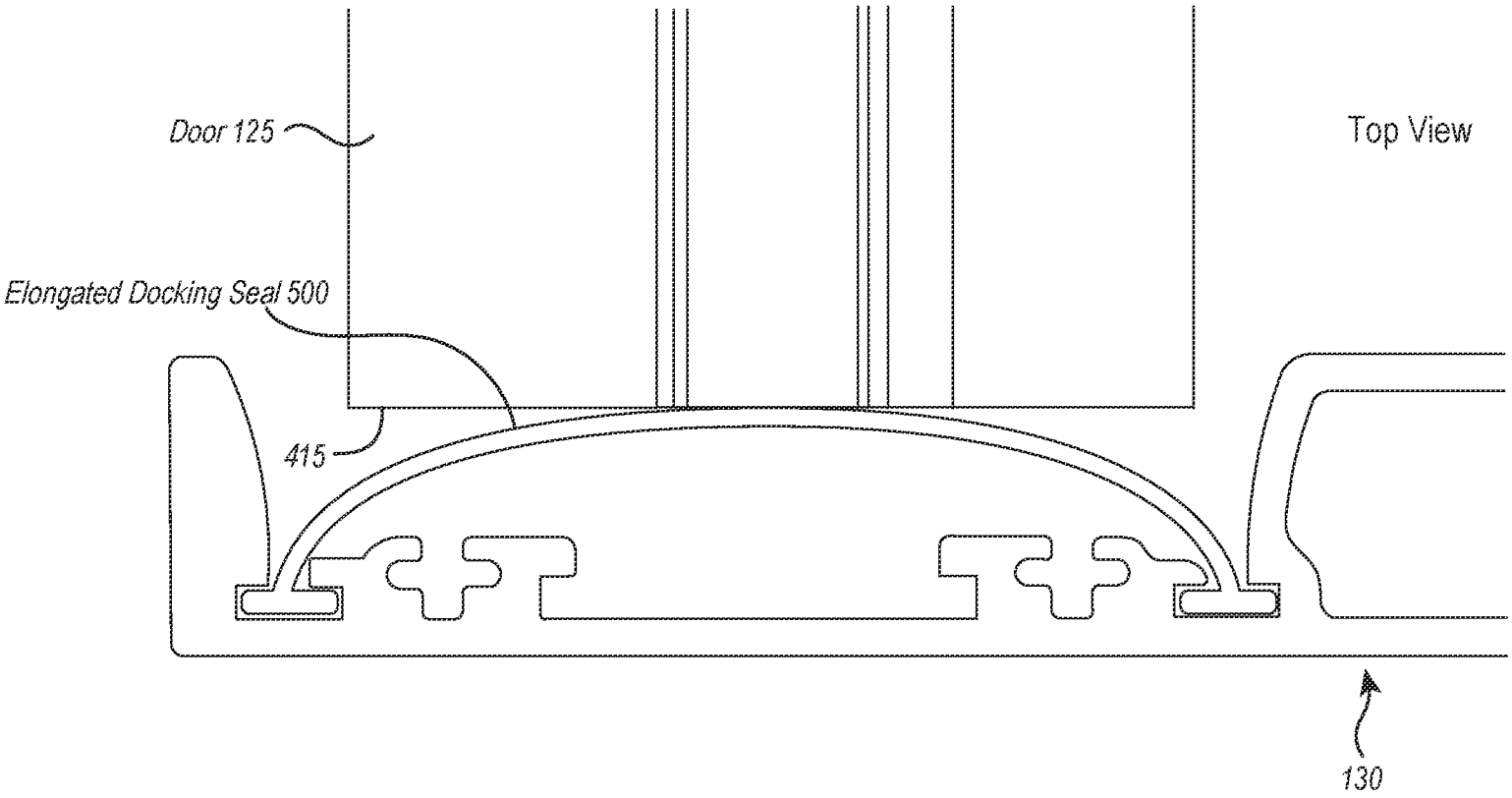
FIG. 5B illustrates a partial cross-sectional view of another implementation of a connection point between a door and door dock of a modular wall than that shown in FIG. 5A.

FIG. 5B shows an additional or alternative implementation of a connection point between a door and door dock of a modular wall. FIG. 5B shows an implementation wherein the door dock 130 does not include a latch receptacle 305. As shown, a single elongated docking seal 500 may be disposed within door dock 130. The elongated docking seal 500 may be connected to the same or different connection interface features in door dock 130 as docking seals 300.

In at least one implementation, a door dock includes multiple docking seals 300 on opposing sides of a latch receptacle 305. However, the docking seals 300 may not extend the entire vertical height of the door dock 130. Rather, above and/or below the latch receptacle 305, the door dock 130 may include a single elongated docking seal 500. Regardless of whether multiple docking seals 300 and/or elongated docking seals 500 are used, the door dock 130 may include one or more seals that engage the door 125 to seal the gap snugly between the door 125 and the door dock 130.

Figure 6:
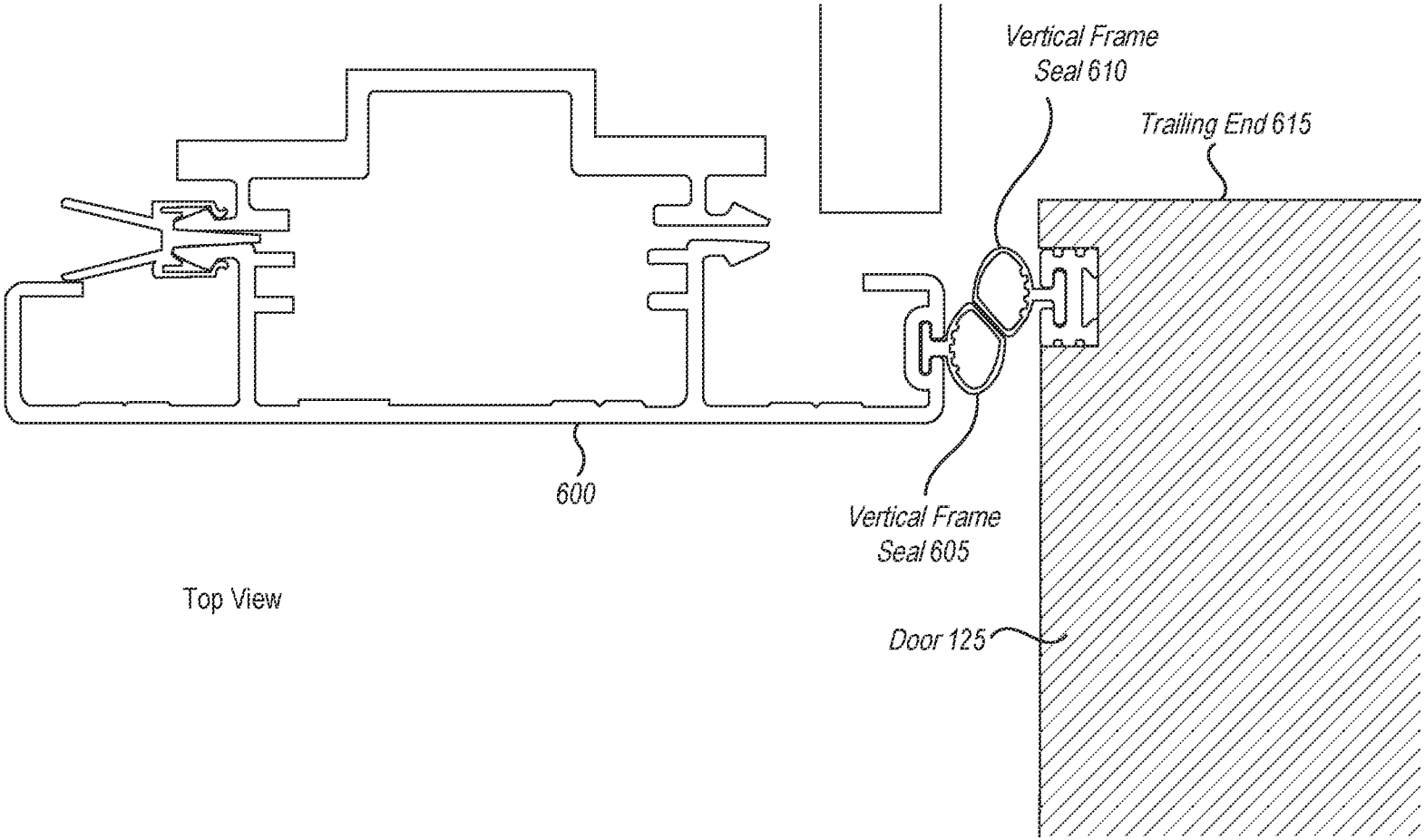
FIG. 6 illustrates a partial cross-section view of a connection point between a trailing end of a door and a vertical frame member.

FIG. 6 illustrates a partial cross-sectional view of a connection point between a trailing end 615 of the door 125 and a vertical frame member 600 of a wall module 110. FIG. 6 shows that the vertical frame member 600 may form part of the doorway through the modular wall system 100. As noted above, seals can be provided around the top and leading edges 415 of the door 125 to limit sound and/or infectious material from passing therearound. Similarly, one or more vertical frame seals can be provided to seal the trailing end 615 of the door 125.

For instance, FIG. 6 illustrates: (i) a first vertical frame seal 605 connected to the vertical frame member 600 and extending toward the door 125, and (ii) a corresponding second vertical frame seal 610 connected to the door 125 and extending toward the vertical frame member 600. When the door 125 is in a closed configuration, as shown in FIG. 6, the vertical frame seals 605 and 610 may engage one another to seal a gap formed between the door 125 and the vertical frame member 600. Although the vertical frame seals 605 and 610 are shown as being slightly laterally offset from one another when the door 125 is closed, in other implementations the vertical frame seals 605 and 610 may be laterally aligned with one another. In any event, the vertical frame seals 605 and 610 can engage one another to seal the gap as noted.

FIG. 6 further shows that the vertical frame seals 605 and 610 can each include connection features that mate with corresponding connection features on the vertical frame member 600 and the door 125 to connect the vertical frame seals 605 and 610 to vertical frame member 600 and door 125. Although FIG. 6 illustrates two vertical frame seals, some implementations include a single vertical frame seal.

For instance, in at least one implementation, the first vertical frame seal 605 extends from the vertical frame member 600 to the door 125 to engage the door 125 to seal the gap between the door 125 and the vertical frame member 600 without the second vertical frame seal 610. Conversely, in at least one implementation, the second vertical frame seal 610 extends from the door 125 to the vertical frame member 600. This can help the seal engage the vertical frame member 600 to seal the gap between the door 125 and the vertical frame member 600 along the entire length.

Figure 7A:
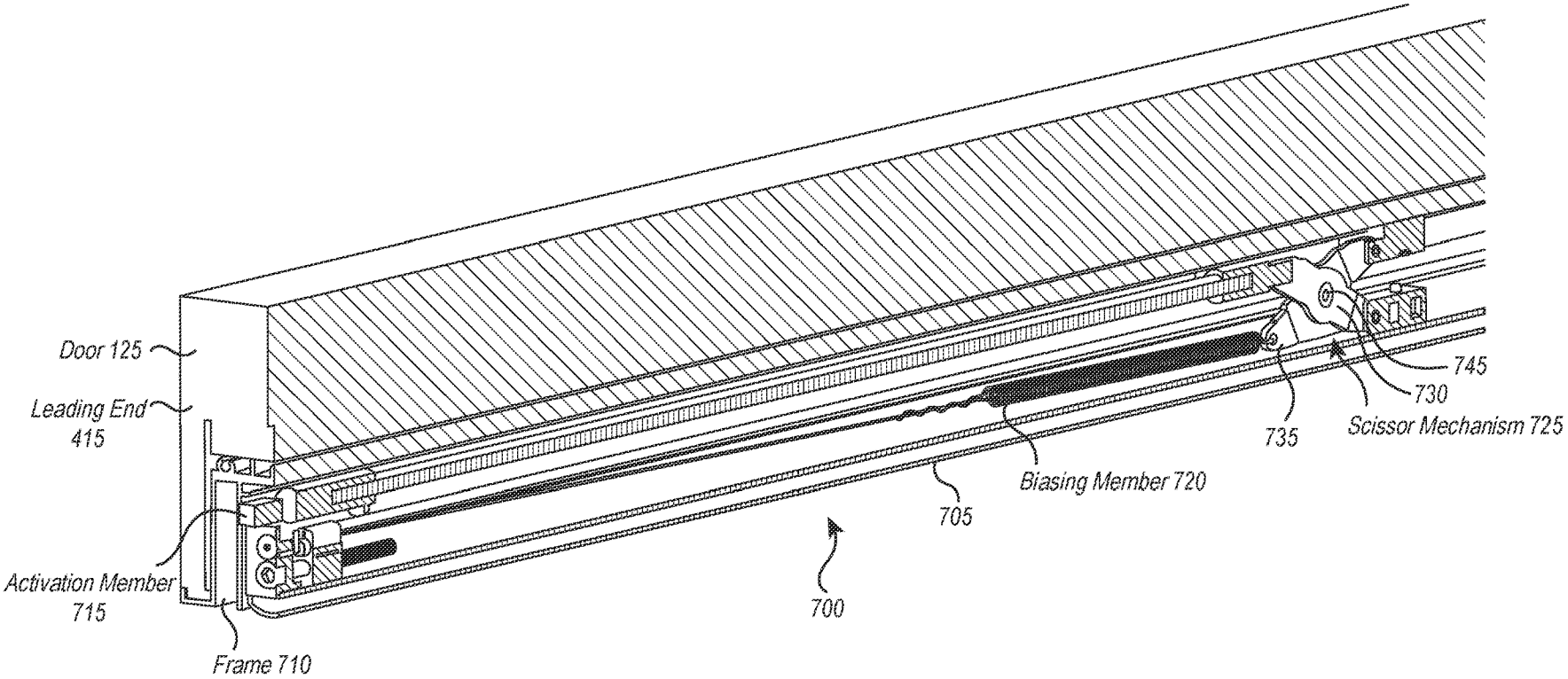
FIG. 7A illustrates a partial cross-sectional view of the lower end of the door and a drop down seal assembly of a modular wall system in accordance with an implementation of the present disclosure.

FIG. 7A illustrates a partial cross-sectional view of the lower end of the door 125 and a drop down seal assembly 700. As understood more fully herein, the drop down seal assembly 700 can be configured to selectively (or automatically) seal the space between the lower end of the door 125 and a floor. One will appreciate that this can help ensure that the door is sealed at each edge thereof (e.g., top/bottom, and left/right edges).

For example, FIG. 7A illustrates that a drop down seal assembly 700 can be disposed within a recess 740 in the lower end of the door 125, and can include a frame 710 connected to a lower end of the door 125. FIG. 7A also shows that the drop down seal assembly 700 can include: (i) an activation member 715, and (ii) a biasing member 720 interconnected via a scissor mechanism 725.

In at least one implementation, the drop down seal assembly 700 is configured so that, when the door 125 is in an open configuration, the activation member 715 extends from the leading end 415 of the door 125. Similarly or alternatively, when the door 125 is in the closed configuration, the activation member 715 contacts the door dock 130, which causes the activation member 715 to be pushed into the door 125.

In at least one implementation, the opposing end of the activation member 715 is connected to a first end of a first scissor member 730 of the scissor mechanism 725. The first scissor member 730, in turn, can pivot to accommodate the movement of the activation member 715. Thus, when the activation member 715 is pushed into the door 125, the first scissor member 730 pivots to a more vertical orientation.

Figure 7B:
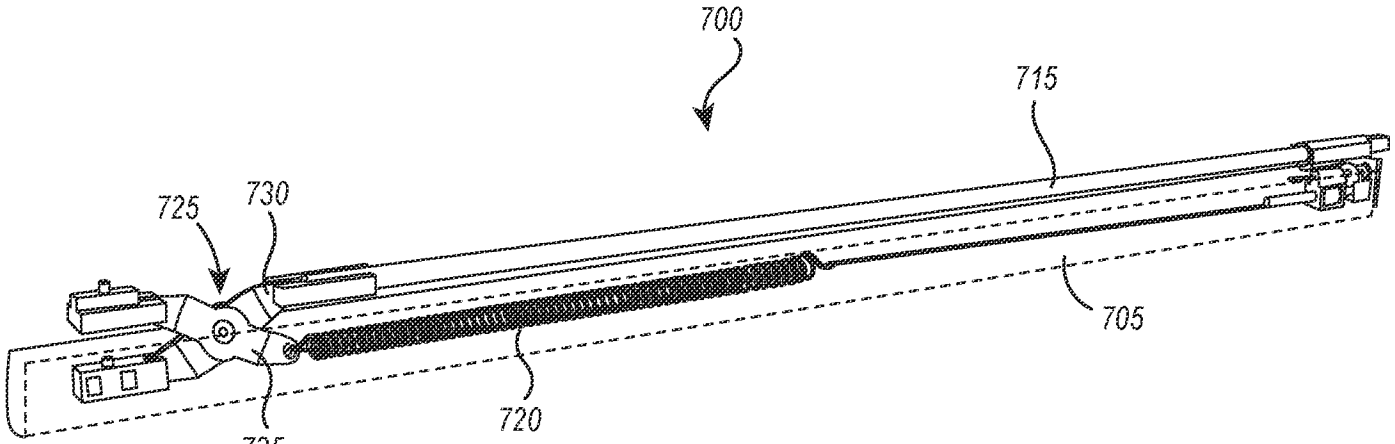
FIG. 7B illustrates the drop seal assembly shown in FIG. 7A in a closed configuration.
Figure 7C:
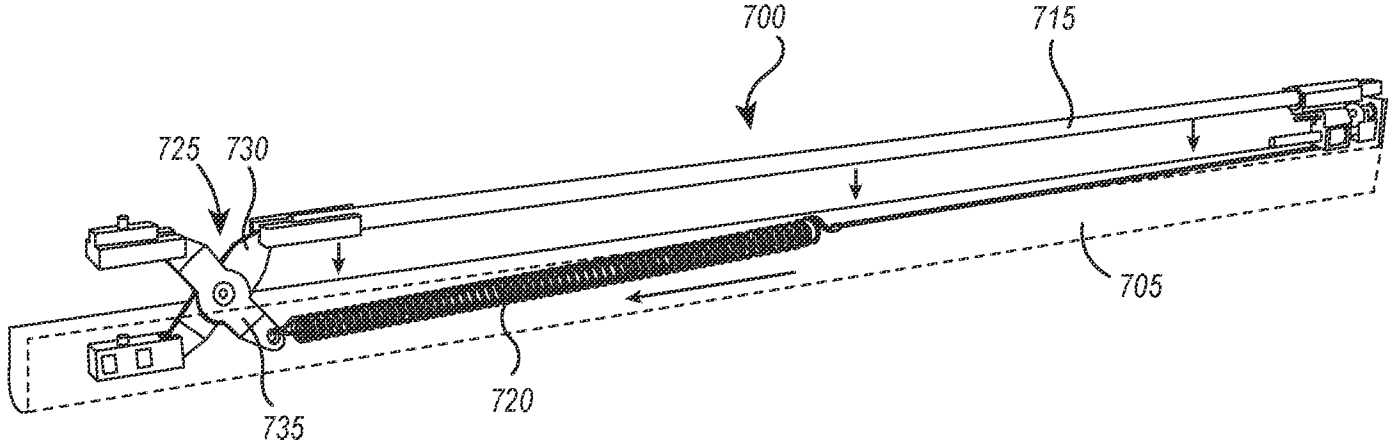
FIG. 7C illustrates the drop seal assembly shown in FIGS. 7A-7B in an open configuration.

A second end of the first scissor member 730 is connected to a drop seal 705, which can be formed of a material (e.g., rubber, PVC, etc.) that is able to flex against the surface of the floor. The pivoting of the first scissor member 730 to a more vertical orientation (e.g., as a result of the inward movement of the activation member 715) causes the drop seal 705 to be lowered from the lower end of the door 125. FIGS. 7A-7C further show that second scissor member 735 is connected between the biasing member 720 and the frame 710. The first and second scissor members 730 and 735 are connected together and pivot about a common pivot point or axis 745.

When the door 125 is an open configuration, the biasing member 720 causes the second scissor member 735 to pivot towards a more horizontal orientation. Pivoting of the second scissor member 735 to a more horizontal orientation causes the first scissor member 730 to likewise pivot to a more horizontal orientation. When the first scissor member 730 pivots to a more horizontal orientation, the drop seal 705 is pulled up by the biasing member 720 into the lower end of the door 125, and the activation member 715 is pushed out so as to extend from the leading edge 415 of the door 125.

FIGS. 7B and 7C further illustrate the drop seal assembly 700 separate from the door 125. In particular, FIG. 7B illustrates the drop seal assembly 700 in a retracted configuration, while FIG. 7C illustrates drop seal assembly 700 in an extended or sealing configuration. As can be seen, the first and second scissor members 730 and 735 are oriented more horizontally in FIG. 7B when the drop seal assembly 700 is in the retracted configuration. This is as compared to the more horizontal orientation shown in FIG. 7C, when the drop seal assembly 700 is in the extended or sealing configuration. Because the first and second scissor members 730 and 735 selectively retract and extend the drop seal assembly 700, the preferred geometry results in purely vertical travel of the drop seal assembly 700 which allows maximization of the length of the seal within the door assembly. Such maximization avoids leaving gaps near the edges of the drop seal assembly 700, which might allow sound and infectious materials to pass more freely therethrough.

When the drop seal assembly 700 is in the extended or sealing configuration as shown in FIG. 7C, the biasing member 720 is stretched. As a result, when the door 125 is moved from a closed configuration to an open configuration, the biasing member 720 will seek to return to its unstretched or retracted length, which will cause the scissor members 730 and 735 to pivot to the more horizontal orientation, thereby raising the drop seal 705 and extending the activation mechanism 715.

One skilled in the art will appreciate that a seal assembly similar to seal assembly 700 may be associated with other portions of a sliding door to provide similar sealing functionality. For instance, a seal assembly similar to seal assembly 700 may be disposed at an upper end of a door. A seal similar to drop seal (or a rising seal) thereof may extend upwardly to engage a doorway header to seal a gap between the door and the doorway header when the door is closed and may be retracted when the door is opened. Similarly, the leading end 415 or trailing end 615 of a door may include a seal assembly similar or identical to seal assembly 700. When the door is closed, a drop seal (or rising, or laterally extending seal) may extend to engage a door dock or a wall module to seal gaps therebetween. When the door is opened, the drop seal(s) may be retracted towards the door.

At least one implementation includes only one or more of the seals disclosed herein, whether at one or both of the door's vertical edges, or one or both of the upper and lower edges. However, including all of the seals disclosed herein in a single door system can seal all of the gaps around the entire perimeter of the door, which can provide the maximum sound attenuation and/or infection control.

Further, one skilled in the art will appreciate that no seals disclosed herein are limited to the seal connection interfaces shown in FIGS. 2-7. For example, FIG. 2 shows track assembly seal 245 with a snap-fit type of seal connection interface between the track assembly seal 245 and shroud 240. However, any of the seals disclosed herein can be inserted, slid, clipped, snapped, or otherwise positioned into their corresponding connection feature. Moreover, the gap between the door 125 and floor can be sealed by a seal similar to the track assembly seals 245 and 250, horizontal frame seals 255, docking seals 300 and 500, or vertical frame seals 605 and 610 rather than by a drop seal 705.

In view of the foregoing the present invention relates for example, without being limited thereto, to the following exemplary embodiments.

In particular, one exemplary embodiment of a sliding door system can comprise a track assembly including a track having a roller channel; a track assembly including a track having a roller channel; a door movably connectable to the track, wherein the door has an open configuration and a closed configuration; one or more track assembly seals disposed between the track assembly and the door; and a drop seal assembly connected to a lower end of the door, wherein the drop seal assembly is configured to seal the gap between the door and a floor when the door is moved from the open configuration to the closed configuration.

Additionally or alternatively in the sliding door system, the one or more track assembly seals include a seal connected to the track and extending towards and engaging the door.

Additionally or alternatively in the sliding door system, the track assembly further includes a shroud connectable to the track; and the one or more track assembly seals include a seal connected to the shroud and extending towards and engaging the door.

Additionally or alternatively in the sliding door system, the drop seal assembly comprises: an activation member that extends from a leading end of the door when the door is in the open configuration, wherein the activation member is pressed inward into the door when the door is moved into the closed configuration; a drop seal that is linked to the activation member such that inward movement of the activation member causes the drop seal to be lowered; a biasing member linked to the drop seal, wherein the biasing member raises or retracts the drop seal when the door is moved from the closed configuration to the open configuration; and a scissor mechanism that links the biasing member and the drop seal.

Additionally or alternatively in the sliding door system further comprises: one or more wall modules, at least one of the wall modules comprising: a horizontal frame member; a doorway header; and a horizontal frame seal connected to at least one of the horizontal frame member and the doorway header, wherein the horizontal frame seal seals a gap between the horizontal frame member and the track.

Additionally or alternatively, the sliding door system further comprises: one or more wall modules, at least one of the wall modules comprising a vertical frame member that forms a portion of a doorway; and a vertical frame seal assembly configured to seal a gap between a trailing end of the door and the vertical frame member when the door is in the closed configuration, the seal assembly comprising at least one of: a vertical frame seal connected to the vertical frame member and extending towards the door; and a vertical frame seal connected to the door and extending towards the vertical frame member.

Additionally or alternatively in the sliding door system, the vertical seal connected to the vertical frame member extends towards and engages the door to seal the gap between the trailing end of the door and the vertical frame member when the door is in the closed configuration.

Additionally or alternatively in the sliding door system, the vertical seal connected to the door extends towards and engages the vertical frame member to seal the gap between the trailing end of the door and the vertical frame member when the door is in the closed configuration.

Additionally or alternatively in the sliding door system, the vertical seal assembly includes both the vertical seal connected to the vertical frame member and extending towards the door and the vertical seal connected to the door and extending towards the vertical frame member, and the vertical seal connected to the vertical frame member and the vertical seal connected to the door engage one another to seal the gap between the trailing end of the door and the vertical frame member when the door is in the closed configuration.

In another exemplary embodiment, a sliding door system can comprise: a track assembly including a track having a roller channel; a door slidably connected to the track assembly to enable the door to move between an open configuration and a closed configuration, the door having a leading end and a trailing end; a drop seal assembly configured to actuate from a non-sealed configuration to a sealed configuration when the door is moved from the open configuration to the closed configuration, thereby sealing a gap between the door and a floor; and a door dock configured to receive or engage the leading end of the door, the door dock comprising one or more docking seals that engage the leading end of the door when the door is closed.

Additionally or alternatively in the sliding door system, the drop seal assembly comprises: an activation member that extends from a leading end of the door when the door is in the open configuration, wherein the activation member is pressed inward into the door when the door is moved into the closed configuration; a drop seal that is linked to the activation member such that inward movement of the activation member causes the drop seal to be lowered; a biasing member linked to the drop seal, wherein the biasing member raises or retracts the drop seal when the door is moved from the closed configuration to the open configuration; and a scissor mechanism that links the biasing member and the drop seal.

Additionally or alternatively in the sliding door system, the door dock further comprises a latch receptacle; and the door further comprises a latch, the latch being configured to selectively engage the latch receptacle to secure the door in the closed configuration.

Additionally or alternatively in the sliding door system, the one or more docking seals comprises a first seal and a second seal, the first and second seals being disposed on opposing sides of the latch receptacle.

Additionally or alternatively in the sliding door system, the latch is disposed within a recess in the leading end of the door and the latch receptacle is configured for insertion into the recess.

A further exemplary embodiment of a sliding door system comprises: a sliding door, wherein the door has an open configuration and a closed configuration; and a drop seal assembly, wherein: the drop seal assembly is configured to actuate from a non-sealed configuration to a sealed configuration when the door moves from the open configuration to the closed configuration, thereby sealing a gap between the door and a permanent structure; and the drop seal assembly is configured to actuate from the sealed configuration to the non-sealed configuration when the door moves from the closed configuration to the open configuration, thereby unsealing the gap between the door and the permanent structure.

Additionally or alternatively in the sliding door system, the drop seal assembly comprises: an activation member that extends from a leading end of the door when the door is in the open configuration, wherein the activation member is pressed inward into the door when the door is moved into the closed configuration; a drop seal that is linked to the activation member such that inward movement of the activation member causes the drop seal to be lowered; a biasing member linked to the drop seal, wherein the biasing member raises or retracts the drop seal when the door is moved from the closed configuration to the open configuration.

Additionally or alternatively in the sliding door system, a scissor mechanism links the biasing member and the drop seal.

Additionally or alternatively in the sliding door system, the scissor mechanism comprises: a first scissor member connected between the activation member and the drop seal; and a second scissor member connected between the biasing member and a frame of the drop seal assembly, wherein the first and second scissor members are pivotally connected to one another and pivot about a common pivot axis.

Additionally or alternatively in the sliding door system, the first and second scissor members are configured to pivot between more vertical and more horizontal orientations; and the drop seal is lowered when the first and second scissor members are pivoted to the more vertical orientation and raised or retracted when the first and second scissor members are pivoted to the more horizontal orientation.

Additionally or alternatively in the sliding door system, the permanent structure comprises a floor, a ceiling, or a wall.

The present invention may be embodied and/or implemented in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A sliding door system, comprising:

a track assembly including a track having a roller channel;

a door movably connectable to the track, wherein the door has an open configuration and a closed configuration;

one or more track assembly seals disposed between the track assembly and the door; and a drop seal assembly connected to a lower end of the door, wherein the drop seal assembly is configured to seal the gap between the door and a floor when the door is moved from the open configuration to the closed configuration, and wherein the drop seal assembly comprises:

a scissor mechanism having a first scissor member pivotally attached to a second scissor member, the first scissor member connected to an activation member to form a first plane, and the second scissor member connected to a biasing member in a second plane that is different from the first plane wherein depression or release of the activation member upon closing or opening the door, respectively, causes the first scissor member to rotate relative to the second scissor member, thereby moving the second plane vertically toward or away from the first plane, and correspondingly engaging or disengaging the drop seal assembly from the floor, and wherein the activation member and biasing member extend in the substantially same longitudinal direction.

2. The sliding door system of claim 1, wherein the one or more track assembly seals include a seal connected to the track and extending towards and engaging the door.

3. The sliding door system of claim 1, wherein:

the track assembly further includes a shroud connectable to the track; and the one or more track assembly seals include a seal connected to the shroud and extending towards and engaging the door.

4. The sliding door system of claim 1, further comprising one or more wall modules, at least one of the wall modules comprising:

a horizontal frame member;

a doorway header; and a horizontal frame seal connected to at least one of the horizontal frame member and the doorway header, wherein the horizontal frame seal seals a gap between the horizontal frame member and the track.

5. The sliding door system of claim 1, further comprising:

one or more wall modules, at least one of the wall modules comprising a vertical frame member that forms a portion of a doorway; and a vertical frame seal assembly configured to seal a gap between a trailing end of the door and the vertical frame member when the door is in the closed configuration, the seal assembly comprising at least one of:

a vertical frame seal connected to the vertical frame member and extending towards the door; and a vertical frame seal connected to the door and extending towards the vertical frame member.

6. The sliding door system of claim 5, wherein the vertical seal connected to the vertical frame member extends towards and engages the door to seal the gap between the trailing end of the door and the vertical frame member when the door is in the closed configuration.

7. The sliding door system of claim 5, wherein the vertical seal connected to the door extends towards and engages the vertical frame member to seal the gap between the trailing end of the door and the vertical frame member when the door is in the closed configuration.

8. The sliding door system of claim 5, wherein:

the vertical seal assembly includes both the vertical seal connected to the vertical frame member and extending towards the door and the vertical seal connected to the door and extending towards the vertical frame member; and the vertical seal connected to the vertical frame member and the vertical seal connected to the door engage one another to seal the gap between the trailing end of the door and the vertical frame member when the door is in the closed configuration.

9. A sliding door system, comprising:

a track assembly including a track having a roller channel;

a door slidably connected to the track assembly to enable the door to move between an open configuration and a closed configuration, the door having a leading end and a trailing end;

a drop seal assembly configured to actuate from a non-sealed configuration to a sealed configuration when the door is moved from the open configuration to the closed configuration, thereby sealing a gap between the door and a floor, and where in the drop seal assembly comprises:

a scissor mechanism, an activation member that extends from a leading end of the door when the door is in the open configuration and is attached to a first end of a first scissor member of the scissor mechanism, wherein the activation member is pressed inward into the door when the door is moved into the closed configuration, a drop seal that is attached to a second end of the first scissor member, wherein the drop seal is linked to the activation member such that inward movement of the activation member causes the drop seal to be lowered, and a biasing member attached to a first end of a second scissor member of the scissor mechanism, wherein the biasing member is linked to the activation member and the drop seal at the scissor mechanism such that the biasing member raises or retracts the drop seal when the door is moved from the closed configuration to the open configuration; and a door dock configured to receive or engage the leading end of the door, the door dock comprising one or more docking seals that engage the leading end of the door when the door is closed, and wherein the activation member and biasing member extend in the substantially same longitudinal direction.

10. The sliding door system of claim 9, wherein:

the door dock further comprises a latch receptacle; and the door further comprises a latch, the latch being configured to selectively engage the latch receptacle to secure the door in the closed configuration.

11. The sliding door system of claim 10, wherein the one or more docking seals comprises a first seal and a second seal, the first and second seals being disposed on opposing sides of the latch receptacle.

12. The sliding door system of claim 10, wherein the latch is disposed within a recess in the leading end of the door and the latch receptacle is configured for insertion into the recess.

13. The sliding door system of claim 9, wherein the activation member forms a first plane, and the biasing member forms a second plane.

14. The sliding door system of claim 13, wherein depression or release of the activation member upon closing or opening the door, respectively, causes the first scissor member to rotate relative to the second scissor member, thereby moving the second plane vertically toward or away from the first plane, and correspondingly engaging or disengaging the drop seal assembly from the floor.

15. A sliding door system, comprising:

a sliding door, wherein the door has an open configuration and a closed configuration; and a drop seal assembly, wherein:

the drop seal assembly is configured to actuate from a non-sealed configuration to a sealed configuration when the door moves from the open configuration to the closed configuration, thereby sealing a gap between the door and a permanent structure; and the drop seal assembly is configured to actuate from the sealed configuration to the non-sealed configuration when the door moves from the closed configuration to the open configuration, thereby unsealing the gap between the door and the permanent structure, and the drop seal assembly comprises:

a scissor mechanism, an activation member that extends from a leading end of the door when the door is in the open configuration and is attached to a first end of a first scissor member of the scissor mechanism, wherein the activation member is pressed inward into the door when the door is moved into the closed configuration, a drop seal that is attached to a second end of the first scissor member, wherein the drop seal is linked to the activation member such that inward movement of the activation member causes the drop seal to be lowered, and a biasing member attached to a first end of a second scissor member of the scissor mechanism, wherein the biasing member is linked to the activation member and the drop seal at the scissor mechanism such that the biasing member raises or retracts the drop seal when the door is moved from the closed configuration to the open configuration, and wherein the activation member and biasing member extend in the substantially same longitudinal direction.

16. The sliding door system of claim 15, wherein the first scissor member is connected between the activation member and the drop seal; and the second scissor member is connected between the biasing member and a frame of the drop seal assembly, wherein the first and second scissor members are pivotally connected to one another and pivot about a common pivot axis.

17. The sliding door system of claim 16, wherein:

the first and second scissor members are configured to pivot between more vertical and more horizontal orientations; and wherein the drop seal is lowered when the first and second scissor members are pivoted to the more vertical orientation and raised or retracted when the first and second scissor members are pivoted to the more horizontal orientation.

18. The sliding door system of claim 15, wherein the permanent structure comprises a floor, a ceiling, or a wall.

19. The sliding door system of claim 15, wherein the activation member forms a first plane, and the biasing member forms a second plane.

20. The sliding door system of claim 15, wherein depression or release of the activation member upon closing or opening the door, respectively, causes the first scissor member to rotate relative to the second scissor member, thereby moving the second plane vertically toward or away from the first plane, and correspondingly engaging or disengaging the drop seal assembly from the permanent structure.

* * * * *